US006079636A

United States Patent [19]

Rembold et al.

[11] Patent Number: 6,079,636

[45] Date of Patent: Jun. 27, 2000

[54] FUEL INJECTION VALVE WITH A PIEZO-ELECTRIC OR MAGNETOSTRICTIVE ACTUATOR

[75] Inventors: Helmut Rembold, Stuttgart; Gottlob Haag, Markgröningen; Heinz Stutzenberger, Vaihingen, all of Germany

[73] Assignee: Robert Bosch GmbH, Stuttgart, Germany

[21] Appl. No.: 09/180,850

[22] PCT Filed: Jan. 12, 1998

[86] PCT No.: PCT/DE98/00080

§ 371 Date: Nov. 17, 1998

§ 102(e) Date: Nov. 17, 1998

[87] PCT Pub. No.: WO98/44256

PCT Pub. Date: Oct. 8, 1998

[30] Foreign Application Priority Data

Mar. 27, 1997 [DE] Germany ..... 197 12 921

[51] Int. Cl.[7] ..... F02M 47/02; B05B 1/08

[52] U.S. Cl. ..... 239/88; 239/90; 239/91; 239/93; 239/95; 239/102.2; 239/533.2; 239/533.4; 239/533.8

[58] Field of Search ..... 239/88, 89, 90, 239/91, 92, 93, 94, 95, 96, 102.2, 533.2, 533.4, 533.8, 533.9

[56] References Cited

U.S. PATENT DOCUMENTS

| | | | |
|---|---|---|---|
| 4,553,059 | 11/1985 | Yasuyuki et al. . | |
| 4,735,185 | 4/1988 | Yuzo et al. . | |
| 4,813,601 | 3/1989 | Schwerdt et al. | 239/93 X |
| 5,803,361 | 9/1998 | Horiuchi et al. | 239/88 |
| 5,845,852 | 12/1998 | Waldman | 239/533.8 |
| 5,884,848 | 3/1999 | Crofts et al. | 239/533.9 X |

FOREIGN PATENT DOCUMENTS

| | | |
|---|---|---|
| 43 06 073 | 6/1994 | Germany . |
| 195 00 706 | 7/1996 | Germany . |
| 8-165967 | 6/1996 | Japan . |
| 8-074702 | 7/1996 | Japan . |

*Primary Examiner*—Andres Kashnikow
*Assistant Examiner*—Robin O. Evans
*Attorney, Agent, or Firm*—Kenyon & Kenyon

[57] ABSTRACT

A fuel injection valve, particularly an injection valve for fuel injection equipment of internal combustion engines, having a pump piston that can be activated using a piezoelectric or magnetostrictive actuator for exerting a translatory pump motion. A spray-discharge nozzle with at least one spray-discharge opening is hydraulically connected via a fuel pressure line to the pump piston. The spray-discharge nozzle opens when the fuel pressure produced by the pump piston in the fuel pressure line exceeds a predetermined threshold. In the fuel pressure line, at least one non-return valve is arranged so that it opens in the direction towards the spray-discharge nozzle and closes in the opposite direction.

13 Claims, 2 Drawing Sheets

FUEL INJECTION VALVE WITH A PIEZO-ELECTRIC OR MAGNETOSTRICTIVE ACTUATOR

FIELD OF THE INVENTION

The present invention relates to a fuel injection valve with a piezoelectric or magnetostrictive actuator.

BACKGROUND INFORMATION

A fuel injection valve with a piezoelectric actuator is described in, for example, German Published Patent Application No. 195 00 706. In this fuel injection valve, the piezoelectric or magnetostrictive actuator controls a working piston that acts upon a stroke piston via a hydraulic path transformer. The stroke piston is connected in a positive-locking manner via a needle valve to a valve closing member provided on a spray-discharge opening. The piezoelectric or magnetostrictive actuator is thus connected via the hydraulic path transformer in a force-locking manner to the valve closing member. If a suitable electric voltage is applied to the actuator, it expands and displaces the working piston accordingly. Even a relatively small displacement of the working piston is transformed by the hydraulic path transformer into a significantly larger displacement of the stroke piston so that the valve closing member releases the spray-discharge opening with a suitable cross-section. A fuel injection valve of a similar construction type is also described in German Patent No 43 06 073. This publication describes a housing-side mounting of the actuator in a special spherical disk support which achieves in the case of a small non-parallelism of the actuator end, a full-surface abutment of the piezoelectric actuator on the pressure piston acted upon by it.

Conventional fuel injection valves have the disadvantage that the injection pressure is predetermined by the fuel pressure generated by the fuel pump in the fuel intake line and thus the available injection pressure is limited. Moreover, there is the disadvantage of a non-negligible mass inertia of the stroke piston, the needle valve and the valve closing member. The response time of the fuel injection valve is determined by the mass inertia of these elements.

SUMMARY OF THE INVENTION

A fuel injection valve according to the present invention has the advantage that the fuel is injected with a relatively high injection pressure. For this purpose, an additional compression of the fuel takes place with a pump piston that can be activated using a piezoelectric or magnetostrictive actuator so that the fuel pressure prevailing in a fuel pressure line between the pump piston and a spray-discharge nozzle is significantly greater than the fuel pressure prevailing in the fuel intake line. The actuation of the spray-discharge nozzle takes place hydraulically in that the spray-discharge nozzle opens if the fuel pressure prevailing in the fuel pressure line exceeds a predetermined threshold. In this manner, the piezoelectric or magnetostrictive actuator provides both an increase of the injection pressure, as well as a hydraulic actuation of the spray-discharge nozzle. Thus, two functions are combined in an extremely compact unit.

Moreover, due to the compact type of construction, relatively short intake paths arise for the fuel so that cavitation problems are avoided. The fuel volume to be compressed by the pump piston is relatively small and is limited only to the volume of the relatively short practicable fuel pressure line as well as the volume within the spray-discharge nozzle which is likewise practicable with very small dimensions. The damage space allocated to the pump piston is thus relatively small so that a relatively small stroke of the pump piston suffices.

The thermal linear expansion compensation of the actuator required in conventional fuel injection valves can be entirely eliminated since the spray-discharge nozzle is actuated hydraulically instead of mechanically via a stroke piston and a needle valve. Slight temperature-dependent displacements of the pump piston due to a temperature-dependent linear expansion of the actuator connected to the pump piston are thus not harmful to the function of the fuel injection valve according to the present invention. The modular design of the fuel injection valve according to the present invention enables an easy-to-assemble plug-in solution that can be assembled within a relatively short assembly time either semiautomatically or fully automatically.

The actuator according to the present invention can be advantageously connected in a force-locking manner via a coupling device containing a partial-sphere-shaped bearing element to the pump piston. The partial-sphere-shaped bearing element ensures that radial forces exerted by the actuator to the translatory main force do not influence in a disruptive manner the translation motion of the pump piston.

The pump piston can be formed particularly advantageously cup-shaped with a fuel prechamber surrounding a central tongue. The central tongue serves to introduce the force of the pressure force exerted by the actuator. Due to the cup-shaped formation of the pump piston, it has a particularly low mass inertia, thereby decreasing additionally the response time of the fuel injection valve according present invention. Moreover, a fuel prechamber is integrated within the pump piston, thereby yielding a particularly compact type of construction. The fuel prechamber may be advantageously sealed with respect to the actuator or the parts accommodating the actuator through a flexible membrane. In this manner, no problematic sealing places result that can produce leakage or wear, e.g., when using a sealing ring. No particular requirements are made of the crushing strength of the membrane since the membrane has only the fuel intake pressure acting upon it.

A non-return valve preventing a backflow of the fuel from the fuel pressure line into the fuel prechamber can be arranged advantageously directly at the entrance of the fuel pressure line. The non-return valve can have a valve piston that forms a seated valve together with a seat surface surrounding an outlet port of the pump piston. Advantageously, a second non-return valve is provided at the outlet of the fuel pressure line or rather at the entrance of the spray-discharge nozzle, which second non-return valve ensures that the fuel pressure does not decrease within the spray-discharge nozzle during the suction stroke of the pump piston.

DETAILED DESCRIPTION

Figure 1:
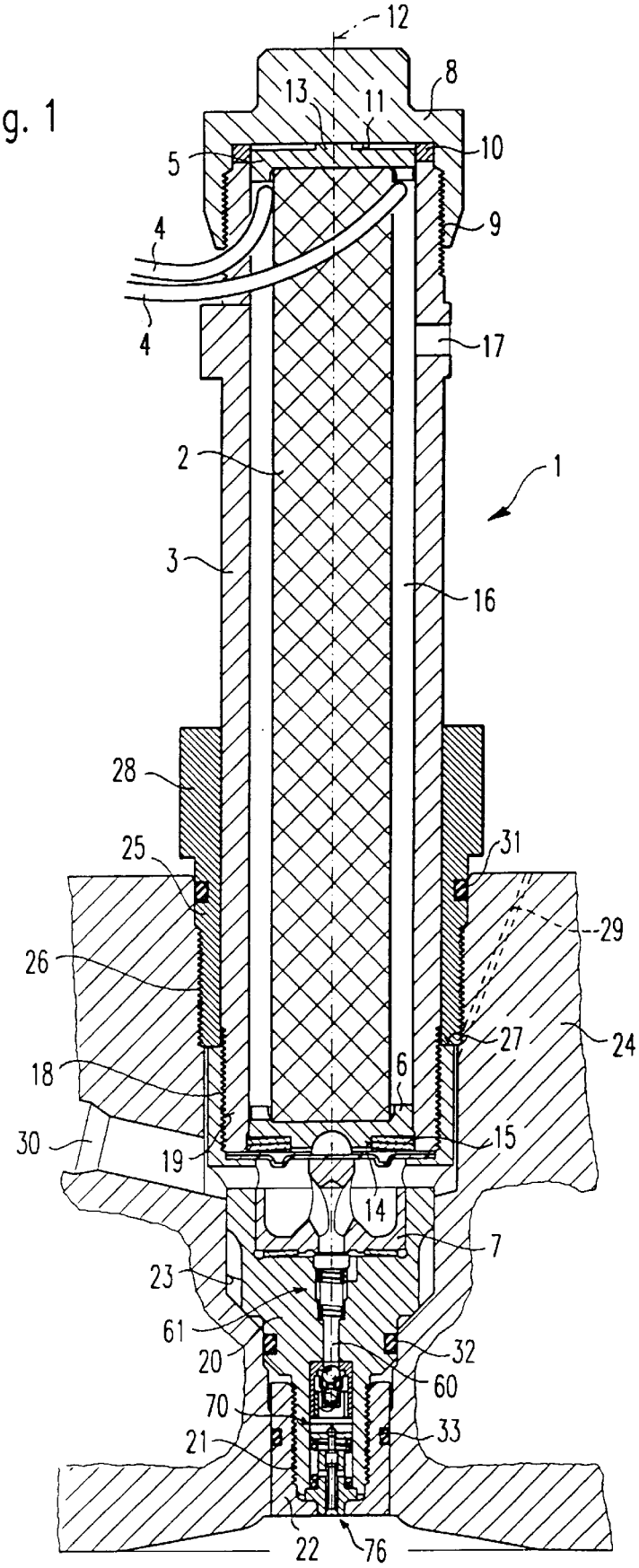
FIG. 1 illustrates an axial section of an exemplary embodiment of the present invention.

FIG. 1 shows, in an axial transverse representation, an overall view of a fuel injection valve 1 according to the present invention. In the shown exemplary embodiment, a piezoelectric actuator 2 is located within an actuator housing 3 and can have an electric supply voltage applied to it via electric supply cables 4. The piezoelectric actuator 2 can be formed as a multilayer piezostack. Instead of the piezoelectric actuator, a magnetostrictive actuator 2 can be used in the same manner. The piezoelectric actuator 2 is accommodated on its free ends by two receiving elements 5, and 6. On its end turned away from a pump piston 7 to be described in greater detail, the piezoelectric actuator 2 is supported via the receiving element 5 in a bearing block 8 that is fastened via a winding 9 on the actuator housing 3. An inner end face 11 of a cup-shaped portion of bearing block 8 is set apart from the actuator housing 3 via a distance ring 10. The receiving element 5 includes, in the area of a longitudinal axis 12 of the actuator 2 or of the fuel injection valve 1, a projection 13 that lies adjacent to the inside end face 11 of the bearing block 8.

On its end adjacent to the pump piston 7, the actuator 2 is supported in a further receiving element 6 that has a ring-shaped opening 14 for accommodating a spring washer 15. The spring washer 15 provides axial prestressing of the actuator 2 to clamp the actuator 2 with a predetermined compressive stress between the receiving elements 5 and 6. A ring space 16 formed between the actuator 2 and the actuator housing 3 can have a liquified or gaseous coolant flowing through it, if necessary, which flows in via a coolant supply opening 17 and flows out via a cooling medium discharge opening (not shown).

On its end adjacent to the pump piston 7, the actuator housing 3 has an outer winding 18 that can be screwed into a corresponding inner winding 19 of a valve block 20. The, valve block 20 can be connected via a winding 21 to a cup-shaped nozzle locking member 22. The actuator housing 3, the valve block 20, and the nozzle locking member 22 can be preassembled as a unit before the fuel injection valve 1 is introduced as a unit into a stepped bore hole 23 of a cylinder head 24 of an internal combustion engine. In the exemplary embodiment, the fuel injection valve 1 is locked using a bushing 25 on the cylinder head 24. The bushing 25 can be screwed into a winding 26 of the stepped bore hole 23 of the cylinder head 24 and contacts, for this purpose, on an end face 27 of the valve block 20. The bushing 25 has a tool engaging member 28, e.g., in the form of an outer hex socket, on which a suitable tool, e.g., a wrench, can engage. There is a ventilation bore hole 29 for ventilation purposes, which can be closed. A feeding of the fuel takes place via a fuel intake line 30 running at least partially within the cylinder head 24. The sealing of the bushing 25, the valve block 20, and the nozzle closing member 22, in each case with respect to the cylinder block 24, takes place via suitable sealing means 31–33 which can be formed, e.g., as O-rings.

Figure 2:
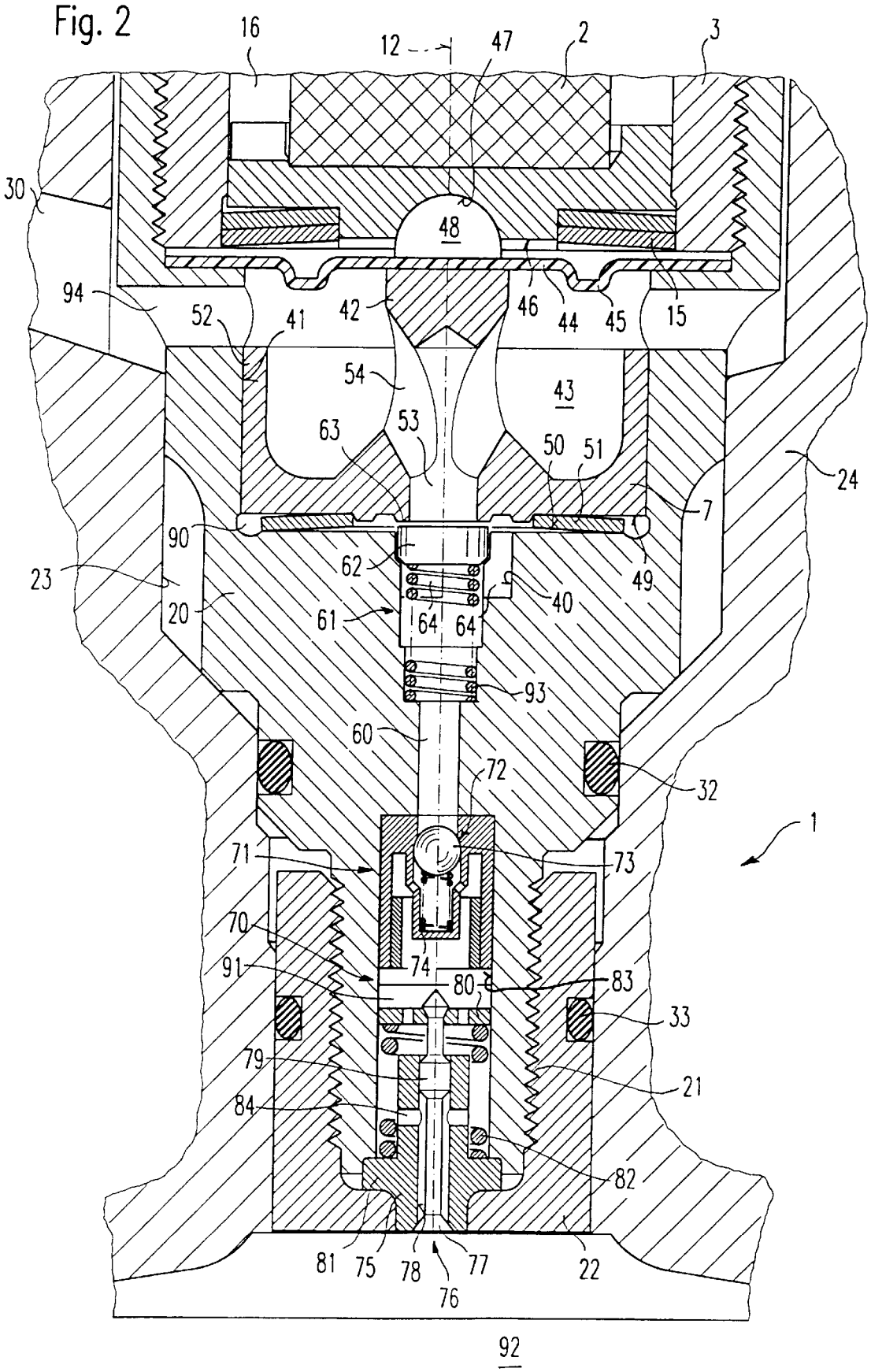
FIG. 2 illustrates an enlarged representation of a spray-discharge-side end of the exemplary embodiment of the present invention.

The further description of the exemplary embodiment makes reference to FIG. 2, which shows an enlarged representation of the spray-discharge-side end area of the fuel injection valve according to the present invention shown in FIG. 1. Elements already described are provided with matching reference numbers.

The valve block 20 is provided with an axial stepped bore hole 40 that extends axially through the entire valve block 20. The cup-shaped and axially-symmetrically-formed pump piston 7 is inserted into a guide segment 41 of the stepped bore hole 40. In the exemplary embodiment shown, the pump piston 7 has, in the area of the longitudinal axis 12, a central tongue 42. The central tongue 42 is surrounded by a ring-shaped fuel prechamber 43 that is connected via radial bore holes 94 provided in the valve block 20 to the fuel intake line 30.

The fuel prechamber 43 is sealed using a flexible membrane 44 that can be made of, e.g., a flexible plastic material with respect to the actuator 2 or rather with respect to the actuator housing 3, the receiving element 6 and particularly with respect to the ring space 16 accommodating the coolant. The membrane can have at least one ring-shaped circumferential enlargement 45 to simplify the deformation. Since the membrane 44 only has a fuel intake pressure prevailing in the fuel intake line 30 acting upon it, no special requirements are made of the crushing strength of the membrane 44. The fuel intake pressure is equal to, e.g., only 3–4 bar. Sealing using the flexible membrane 44 has the advantage that leakage or wear is avoided which can occur, for example, when using a sealing ring following a longer operating interval of the fuel injection valve 1.

The receiving element 6 adjacent to the pump piston 7 has on an end face 46, opposite the pump piston 7, a spherical opening 47 into which a partial-sphere-shaped, e.g., hemispherical, bearing element 48 is inserted. The bearing element 48 lies opposite the central tongue 42 of the pump piston 7 and is separated from it by the flexible membrane 44. Between a spray-discharge-side end face 49 of the pump piston 7 and a contact surface 50 of the stepped bore hole 23 of the valve block 20, there is a spring washer 51 that holds the central tongue 42 of the pump piston 7 constantly in contact with the bearing element 48. The receiving element 6 is, tiltable with respect to the bearing element 48 due to the spherical formation of the boundary surface in certain boundaries. If the receiving element 6 tilts slightly with respect to the longitudinal axis 12 when the actuator 2 is actuated, full-surface contact of the bearing element 48 on the membrane 44 and thus directly on the central tongue 42 of the pump piston 7 is not impaired.

The pump piston 7 has a hollow-cylindrical-shaped wall segment 52 that is guided in the guide segment 41 of the stepped bore hole 40. On its spray-discharge-side end, the pump piston 7 has a central outlet port 53 that is connected via cross bore holes 54 to the ring-shaped fuel prechamber 43. The outlet port 53 of the pump piston 7 discharges into a fuel pressure line 60. At the inlet of the fuel pressure line 60, there is a first non-return valve 61 in the shown exemplary embodiment. In the exemplary embodiment, the first non-return valve 61 is made of a cylindrical valve piston 62 that is pressed using a spring element 93, e.g., a helical spring, against the end surface 49 of the pump piston 7. The valve piston 62 interacts with the pump piston 7 to form a flat seated valve, the valve piston 62 sealingly abutting in a closed position of the non-return valve 61 on a seating surface 63 surrounding the outlet port 53 of the pump piston 7 and raising when the non-return valve 61 is opened from the seating surface 63.

The end face 49 and the contact surface 50 delimit a pump chamber 90 whose volume is determined by the axial position of the pump piston 7 and which is connected via preferably multiple, e.g., three, connecting slots 64 surrounding the valve piston 62 to the fuel pressure line 60. At the outlet of the fuel pressure line 60 or rather at the entrance of a spray-discharge nozzle 70 to be described in more detail, there is a second non-return valve 71. The second non-return valve 71 is made of a valve seat 72 closing the fuel pressure line 60. The valve seat 72 is closable by a valve member 73, which is spherical in the exemplary embodiment. The valve member 73 is pressed using a spring element 74 against the valve seat 72.

Downstream from the second non-return valve 71, there is a nozzle member 75 with a spray-discharge opening 76. The spray-discharge opening 76 is sealable using a valve closing member 77, which is connected to a spring disk 80 using a needle valve 79. The needle valve 79 penetrates an axial longitudinal bore hole 78 of the nozzle member 75. Between the spring disk 80 and a ring crimp 81 of the nozzle member 75, a prestressed resetting spring 82, e.g., a helical spring, is clamped which prestresses the valve closing member 77 of the outwards opening spray-discharge nozzle 70 in a closed position. The fuel flows into the nozzle member 75 via a segment 83 of the stepped bore hole of the valve block 20 used to accommodate the non-return valve 71 and the nozzle member 75 and is directed through this using radial bore holes 84 through to the longitudinal bore hole 78 surrounding the needle valve 79 and finally to the spray-discharge opening 76.

The function of the fuel injection valve 1 according to the present invention is described below in greater detail.

The fuel flows via the fuel intake line 30 into the pre-chamber 43. If the piezoelectric actuator 2 has the supply voltage applied to it, it expands as a function of a magnitude of the supply voltage. Based on the axial expansion of the actuator 2, the axial position of the pump piston 7 is determined, which is held in contact using the spring washer 51 on the bearing element 48 and on the receiving element 6 connected to the pump-piston-side free end of the actuator 2. If the supply voltage of the actuator 2 is reduced, its axial expansion reduces so that the pump piston 7 moves in the direction towards the actuator 2 and the volume of the pump chamber 90 formed between the end face 49 of the pump piston 7 and the contact surface 50 of the valve block 20 is increased. Due to the increasing volume of the pump chamber 90, a reduced pressure arises in the fuel pressure line 60, which drops below the fuel pressure prevailing in the fuel prechamber 43. The fuel pressure line 60 is closed in this process by the second non-return valve 71 towards the spray-discharge nozzle 70. The underpressure arising in the fuel pressure line 60 with respect to the fuel prechamber 43 causes an opening of the first non-return valve 61 in that the valve piston 62 raises from the seating surface 63 formed on the pump piston 7. The fuel thus flows during the suction stroke of the pump piston 7 described above via the opening first non-return valve 61 into the pump chamber 90, whose volume grows increasingly with the increasing suction stroke of the pump piston 7. To be able to fill the pump chamber 90, e.g., in the spring washer 51 axial bore holes or intake channels on the bearing surfaces of the spring washers 49, 50 are present.

If the supply voltage of the actuator 2 is increased again, this results in an increasing axial expansion of the actuator 2. The pump piston 7 is thus moved in the direction towards the spray-discharge nozzle 70 so that the volume of the pump chamber 90 decreases increasingly. In this manner, an overpressure arises in the pump chamber 90 and the fuel pressure line 60 connected to it with respect to the fuel prechamber 43. As a result, the first non-return valve 61 closes in that the valve piston 62 makes contact on the seating surface 63 formed on the pump piston 7.

As soon as the fuel pressure prevailing in the fuel pressure line 60 exceeds the fuel pressure prevailing within the spray-discharge nozzle 70, the second non-return valve 71 opens so that fuel under an increased pressure flows out of the fuel pressure line into the inner volume 91 of the spray-discharge nozzle 70. The fuel pressure prevailing in the inner volume 91 of the spray-discharge nozzle 70 acts upon the valve seat 77 with a controlling force directed in the direction of the spray-discharge opening 76. As soon as this pressure-dependent controlling force exceeds a restoring force exerted by the resetting spring 82, the valve closing member 77 connected via the needle valve 79 to the spring disk 80 releases the spray-discharge opening 76 so that the fuel is injected into a frontally arranged combustion chamber 92 of the internal combustion engine. The threshold of the pressure at which the spray-discharge nozzle 70 opens is dependent on the restoring force exerted by the resetting spring 82 and is specifiable via the spring constant and prestressing of the resetting spring 82.

The actuator 2 of the fuel injection valve 1 according to the present invention thus fulfills two functions: On the one hand, by means of the pump piston 7 driven by the actuator 2, a pressure increase of the fuel is achieved so that the spray-discharge pressure of the fuel is significantly greater than the fuel intake pressure prevailing in the intake line 30. Very good injection properties are achieved due to the increased spray-discharge pressure of the fuel. On the other hand, the actuator 2 provides indirect hydraulic actuation of the spray-discharge nozzle 70.

As compared with purely mechanical actuation, the hydraulic actuation of the spray-discharge nozzle 70, or rather, the valve closing member 77 has the advantage of low mass inertia of the overall system and thus a low response time. On the fuel injection valve 1 according to the present invention, the intake paths are relatively short, thereby avoiding cavitation problems. A contaminant space between the pump piston 7 and the spray-discharge opening 76 has a relatively small volume, which additionally reduces the response time of the fuel injection valve 1. Thermal linear expansion compensation of the actuator 2 is not necessary since slight static displacements of the pump piston 7 have no influence on the dynamic function of the fuel injection valve 1.

A ring gap remaining between the wall segment 52 of the pump piston 7 and the guide segment 41 of the axial longitudinal bore hole 40 likewise has no critical influence on the dynamic response of the fuel injection valve 1 according to the present invention. The ring gap and thus the piston play of the pump piston 7 can equal 3–4 $\mu$m without any problem, without the leakage occurring at the ring gap influencing the injection quantity significantly. Since the regulating time of the actuator 2 is on the order of magnitude of 1 ms, no significant leakages occur during the regulating time of the pump piston 7 on the ring gap between the wall segment 52 and the guide segment 41. Thus, no excessive requirements are placed on the manufacturing tolerances of the outer diameter of the pump piston 7 or rather the inner diameter of the guide segment 41 so that the manufacturing costs of the fuel injection valve 1 according to the present invention are not significantly increased through the fitting of the pump piston 7 into the guide segment 41 of the stepped bores hole 40.

The fuel injection quantity can be influenced by the magnitude of the supply voltage which is applied to the piezoelectric actuator 2 since the expansion of the actuator 2 is proportional to the supply voltage. The supply voltage is on the order of magnitude of up to 1000 V. However, other piezostacks with a lower voltage are also possible.

The invention is not restricted to the exemplary embodiment shown. In particular, pump pistons 7, non-return valves 61 and 71, and spray-discharge nozzles 70 in other known forms can be used.

What is claimed is:

1. A fuel injection valve for an internal combustion engine, comprising:

a pump piston driven by one of a piezoelectric actuator and a magnetostrictive actuator to exert a translatory pump motion;

a spray-discharge nozzle communicating hydraulically with the pump piston via a fuel pressure line and having at least one spray-discharge opening which opens when a fuel pressure produced by the pump piston in the fuel pressure line exceeds a predefined threshold value; and at least one check valve arranged in the fuel pressure line that opens in a direction of the spray-discharge nozzle and closes in an opposite direction.

2. The fuel injection valve according to claim 1, wherein the one of the piezoelectric actuator and the magnetostrictive actuator has a force-locking operative connection via a coupling device to the pump piston, the pump piston being held in contact with the coupling device by a first spring element.

3. The fuel injection valve according to claim 2, wherein the coupling device includes a receiving element for accommodating a free end of the one of the piezoelectric actuator and the magnetostrictive actuator, and further includes a partial-sphere-shaped bearing element that engages in a spherical opening of the receiving element.

4. The fuel injection valve according to claim 1, wherein the pump piston is cup-shaped with a fuel prechamber surrounding a central tongue, the central tongue having a force-locking operative connection to the one of the piezoelectric actuator and the magnetostrictive actuator.

5. The fuel injection valve according to claim 4, wherein a flexible membrane seals the fuel prechamber with respect to the one of the piezoelectric actuator and the magnetostrictive actuator.

6. The fuel injection valve according to claim 5, wherein the coupling device includes a receiving element for accommodating a free end of the one of the piezoelectric actuator and the magnetostrictive actuator, and further includes a partial-sphere shaped bearing element that engages in a spherical opening of the receiving element, and wherein the partial-sphere-shaped bearing element of the coupling device is positioned opposite to the central tongue of the pump piston, and the flexible membrane is arranged between the partial-sphere-shaped bearing element and the central tongue.

7. The fuel injection valve according to the claim 6, wherein the fuel prechamber is coupled to a fuel intake line, and is further connected, via cross bore holes which penetrate the central tongue, to an outlet port emptying into the fuel pressure line.

8. The fuel injection valve according to claim 7, wherein a first check valve of the at least one check valve arranged at the entrance of the fuel pressure line, the first check valve including a seated valve with a valve piston, the valve piston contacting in a closed position with a seat surface of the pump piston, and sealing an outlet port of the pump piston.

9. The fuel injection valve according to claim 8, further comprising:

a second spring element holding the valve piston in contact with the seat surface of the pump piston as long as a fuel pressure prevailing in the fuel pressure line does not exceed a fuel pressure prevailing in the fuel prechamber.

10. The fuel injection valve according to claim 8, wherein an end face of the pump piston borders a pump chamber, a volume of the pump chamber being determined by a position of the pump piston, the pump chamber being coupled to the fuel pressure line directly and to the fuel prechamber via the outlet port of the pump piston, and the outlet port being sealable by a first check valve of the at least one check valve.

11. The fuel injection valve according to claim 1, wherein a second check valve of the at least one check valve is provided at one of an outlet of the fuel pressure line and an inlet of the spray-discharge nozzle.

12. The fuel injection valve according to claim 1, wherein the spray-discharge nozzle includes a valve closing member which seals the at least one spray-discharge opening, a spring element acting upon the valve closing member in a direction towards a closed position and wherein the at least one spray-discharge opening releases when the fuel pressure acting upon the valve closing member exceeds the predefined threshold value.

13. A fuel injection valve for an internal combustion engine, comprising:

a pump piston driven by one of a piezoelectric actuator and a magnetostrictive actuator to exert a translatory pump motion;

a spray-discharge nozzle communicating hydraulically with the pump piston via a fuel pressure line and having at least one spray-discharge opening which opens in response to a fuel pressure produced by the pump piston in the fuel pressure line exceeding a predefined threshold value; and at least one check valve arranged in the fuel pressure line that opens in a direction of the spray-discharge nozzle and closes in an opposite direction.

* * * * *